United States Patent [19]

Pereira et al.

[11] 4,398,556

[45] Aug. 16, 1983

[54] FIRE HYDRANT COVER

[76] Inventors: Eloy Pereira, 3400A Paul Ave., Bronx, N.Y. 10468; Arnold N. Lefkowitz, 247 W. Drake Ave., New Rochelle, N.Y. 10805

[21] Appl. No.: 288,102

[22] Filed: Jul. 29, 1981

[51] Int. Cl.[3] ..... E03B 9/06; E03B 9/14

[52] U.S. Cl. ..... 137/296; 137/800; 220/85 P

[58] Field of Search ..... 137/296, 371, 377, 382, 137/382.5, 800; 220/85 P, 284, 285, 286

[56] References Cited

U.S. PATENT DOCUMENTS 2,118,233 5/1938 Ruggio ..... 137/296

3,453,655 7/1969 Quinones et al. ..... 137/296

4,033,372 7/1977 Bowman ..... 137/382

FOREIGN PATENT DOCUMENTS 619436 9/1935 Fed. Rep. of Germany ..... 137/296

*Primary Examiner*—George L. Walton

[57] ABSTRACT

A cup-shaped cover for a fire hydrant includes an opening therethrough for rotatably receiving a special tool that opens and closes the fire hydrant valve. In order to provide for complete drainage, at least two channels are formed in the top surface of the cover. The channels slope downwardly from a location proximate the valve stem of the fire hydrant to a location opposite a portion of the valve body.

24 Claims, 10 Drawing Figures

FIG. 1
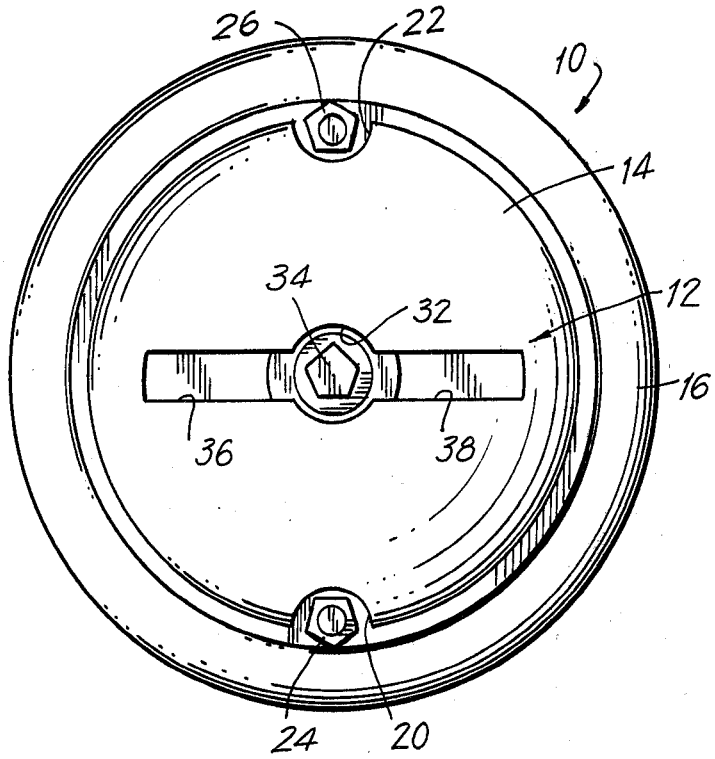
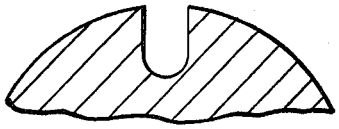
FIG. 8A
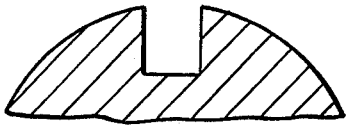
FIG. 8B
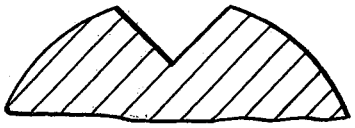
FIG. 8C
FIG. 2
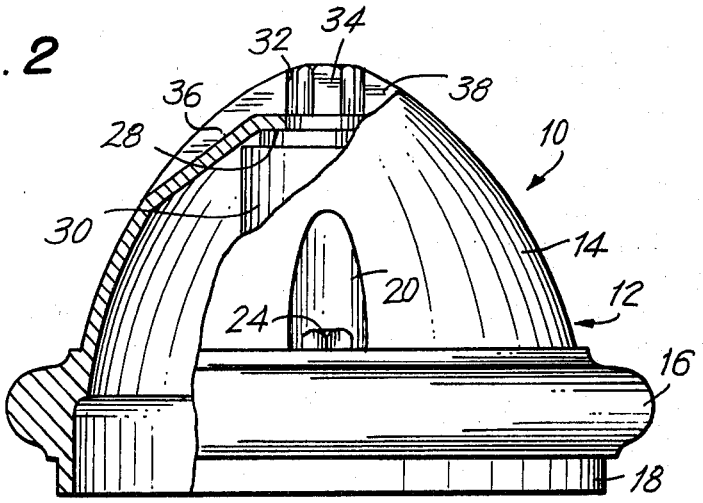

FIG. 3
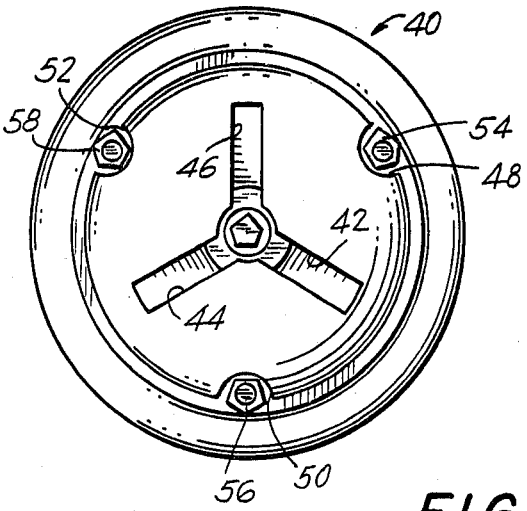
FIG. 4
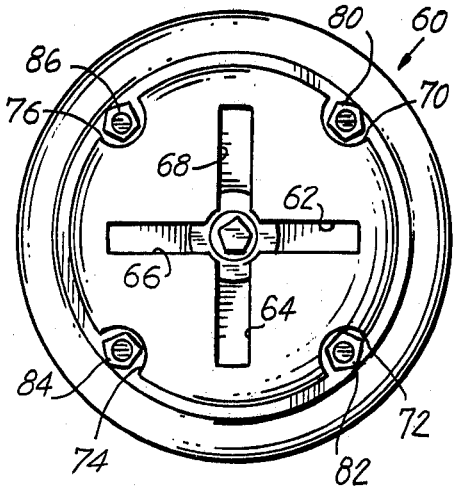
FIG. 5
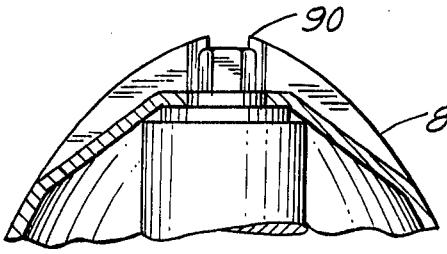
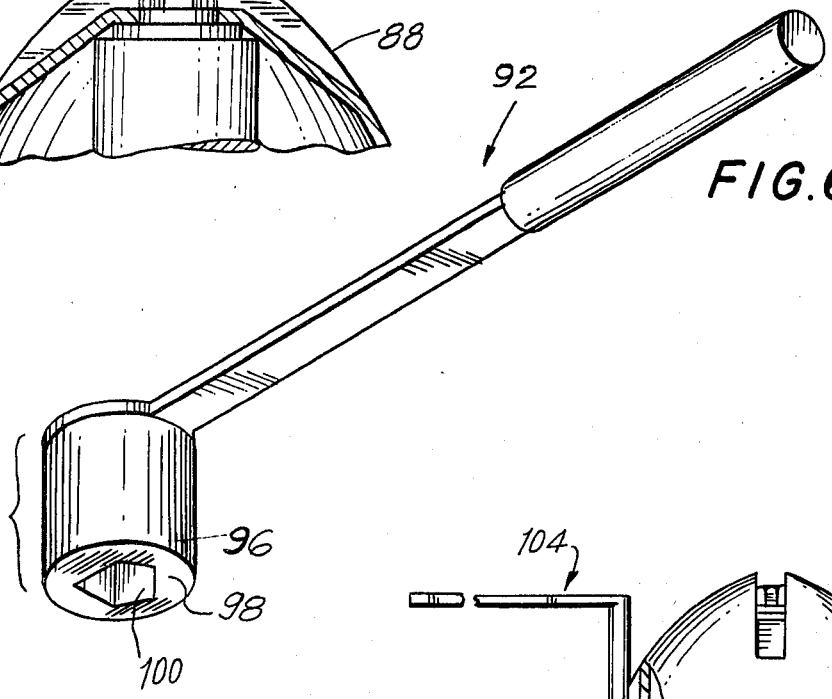
FIG. 6
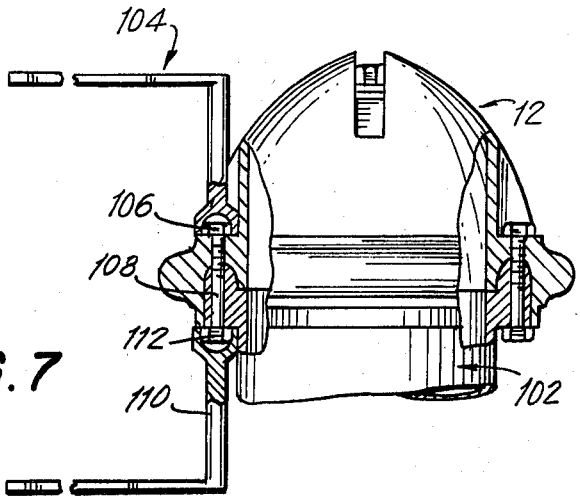
FIG. 7

FIRE HYDRANT COVER

This invention relates generally to fire hydrants and more particularly to an improved cover therefor.

Many attempts have been made to protect the projecting valve stem of a fire hydrant in order to render the fire hydrant relatively cup-shaped. One example of such an attempt is disclosed in U.S. Pat. No. 3,453,655 granted on Dec. 19, 1966 to Carlos M. Quinones and Bonifacio Garcia. In this patent there is disclosed a street hydrant having a dome at the top of the stand pipe portion. A stuffing box is located in the dome and contains the valve mechanism including a valve body and a valve stem which has a nut portion that projects upwardly of the dome. A guard device is provided on the top of the dome for protecting the projecting nut portion. The guard device includes a cylindrical hollow housing formed integrally with the top portion of the dome and disposed above and around the wrench nut portion. The dome is further provided with an axial opening that is in alignment with the wrench nut portion.

A plurality of radially arranged openings are formed in the side of the top-most portion of the dome. It is the intent of the patentee to have the radially oriented holes in the side wall of the dome provide means for draining debris and fluid from the area around the wrench nut portion.

While the structure disclosed in the Quinones et al patent is effective it does have at least one very serious drawback that is readily apparent from even a cursory reading of the drawing. That is, the radial openings in the dome do not provide adequate means for draining any liquid or solids that might accumulate in the cylindrical portion of the dome that surrounds the wrench nut portion. Furthermore, The radially oriented openings in the side wall of the dome of the Quinones et al patent are readily subjected to becoming packed with debris, either intentionally or unintentionally. Thus, either the debris in the radial openings or accumulated fluid that can freeze in the topmost cylindrical portion of the dome in the Quinones et al structure can very easily prevent rapid utilization of the fire hydrant on an emergency basis.

Still other examples of the prior art technology to which the present invention is directed is shown in U.S. Pat. Nos. 3,623,498 and 4,033,372 granted on Nov. 30, 1971 and July 5, 1979, respectively, to Gerald J. Manahan and Harold M. Bowman. Both of these issued U.S. patents relate to means for preventing tampering with a fire hydrant and both of the patents require that an element be removably coupled to the dome of the fire hydrant. While both of these patents describe structure that is effective in minimizing tampering with or unauthorized use of the fire hydrant, it will be evident that both devices require the rapid removal of an external part before access can be had to the valve stem. Clearly, this is detrimental to the rapid and efficient utilization of the fire hydrant.

Still another example of the prior art in the field to which the present invention is directed is disclosed in U.S. Pat. No. 2,118,233 granted on May 24, 1938 to Toby Ruggio. In the last mentioned U.S. patent, a collar having an axial opening is held in opposition to the valve stem by means of three straps which are bolted to a flange on the fire hydrant. The purpose of the Ruggio structure is to prevent the unauthorized use of the fire hydrant. However, because sloping drainage means are not provided it is entirely possible for water to accumulate on top of the stuffing box cap and around the valve stem nut. In freezing weather this construction can very easily lead to malfunctioning of the fire hydrant and a substantial delay in opening the hydrant.

A further example of the prior art in the fire hydrant field is disclosed in U.S. Pat. No. 3,450,148 granted on June 17, 1969 to Ralph V. Mongelluzzo et al. This patent provides a special valve stem having a triangular configuration over which fits a cap. A bolt requiring a special key for removal extends through the upper portion of the fire hydrant body, the valve stem and the cap. Clearly, because an element must be removed before the fire hydrant can be utilized there is an element of danger in that time will be lost in spite of the fact that the patented device does provide means for effectively locking the valve stem.

Each example of the prior art discussed hereinabove suffers one or more of the following defects:

1. not sufficiently tamper-resistant in that tampering may result in either destruction or jamming of the structure;
2. insufficient liquid drainage;
3. where liquid drainage is sufficient, solid debris may accumulate resulting in liquid blockage;
4. the structure is complicated to manufacture and/or operate;
5. "add-on" devices are not usually able to completely prevent the unauthorized use of the hydrant; and
6. "add-on" devices require an additional step of removal in locking, unbolting etc. before the hydrant valve can be manipulated.

The present invention very clearly distinguishes over the prior art in that a standard valve body and a standard valve stem are utilized in combination with a hydrant cover dome that has improved means for draining any liquids that may accumulate around the upper portion of the valve stem. The present invention provides an opening in the top of the dome for rotatably receiving a tool that is adapted to mate with and angularly displace the valve stem between open and closed positions. The drainage means which may be in the form of U-shaped or V-shaped channels are formed in the outer surface of the hydrant dome such as by casting or the like and slope downwardly from a location proximate the valve stem to a location opposite a portion of the valve body where fluids can drain therefrom. The drainage channels or grooves may have two opposed side walls and a base wall and there may be two, three, four or more drainage channels equally spaced apart. The means for coupling the hydrant cover dome to the body of the fire hydrant are in the form of openings located proximate the open, lower end of the dome which are positioned intermediate the lower or outermost end of the drainage channels or troughs. In one embodiment of the present invention the top of the hydrant dome is in substantially the same plane as the top of the valve stem while in an alternative embodiment the top of the hydrant dome is in a plane that is above the top plane of the valve stem.

Accordingly, it is an object of the present invention to provide an improved cover for a fire hydrant.

It is another object of the present invention to provide an improved cover for a fire hydrant that is substantially tamper-proof.

An additional object of the present invention is to provide a cover for a fire hydrant wherein improved drainage means are included.

In the drawings, like reference characters designate like parts.

IN THE DRAWINGS:

FIG. 1 is a plan view illustrating a first embodiment of the fire hydrant cover comprising the present invention;

FIG. 2 is an elevational view, partially broken away and partially in section illustrating the embodiment of the present invention shown in FIG. 1;

FIG. 3 is a plan view, on a reduced scale, similar to FIG. 1 but illustrating an alternative embodiment of the present invention;

FIG. 4 is a plan view, on a reduced scale, similar to FIG. 1 but illustrating another alternative embodiment of the present invention;

FIG. 5 is a fragmentary sectional elevational view illustrating a modification of the present invention;

FIG. 6 is an exploded, perspective view illustrating a tool that may be utilized with the present invention;

FIG. 7 is a fragmentary sectional elevational view illustrating tools that my be employed for mounting the improved fire hydrant cover of the present invention on to the body of a fire hydrant; and FIGS. 8A, 8B and 8C are fragmentary views in transverse cross-section illustrating the configuration of several embodiments of the drainage channels comprising the present invention.

Referring now to the drawings, and particularly to FIGS. 1 and 2, there is shown the first embodiment of the improved fire hydrant cover 10 comprising the present invention. The cover 10 comprises an inverted, cup-shaped dome or shell generally designated by the reference character 12 having an upper portion 14, a circumferential rib 16 that is optional depending on the locality of use and a skirt 18. In the first embodiment of the present invention two recesses 20 and 22 are formed in the upper portion 14 immediately above the circumferential rib 16 for the purpose of receiving fastener means 24 and 26, respectively, that are used to fasten the dome 12 to the body of the fire hydrant as will be explained in connection with FIG. 7.

As best shown in FIG. 2, the wall of the dome 12 is thickened at the upper end thereof and an internal shoulder 28 is formed thereon. The shoulder 28 is arranged to rest on the valve stem 30 of the fire hydrant mechanism. As further shown in FIG. 2, the upper portion 14 is provided with a centrally located axial opening 32 in which is positioned the valve stem 34 of the fire hydrant mechanism. The valve stem 34 is conventional and is very frequently of pentagonal shape. Sufficient clearance is left between the opening 32 and the valve stem 34 to receive an appropriately shaped tool which will be described in connection with FIG. 6.

Referring now to FIG. 1 in combination with FIG. 2 it will be seen that two generally radially oriented channels or grooves 36 and 38 are formed in the upper portion 14 of the dome 12 such as by casting, machining or the like. The channels 36 and 38 slope downwardly with the upper end thereof being located at a position proximate the valve stem 34. The bottom end of the channels 36 and 38 terminate opposite a portion of the valve body 30. The channels or grooves 36 and 38 just described define the drainage means for the present invention.

FIG. 3 illustrates an alternative embodiment of the present invention. Whereas there were two drainage channels and two coupling means in the first embodiment as represented by FIGS. 1 and 2, the embodiment of the dome 40 shown in FIG. 3 provides three drainage channels 42, 44 and 46 in the upper portion 48 thereof as well as three coupling means in the form of recesses 48, 50 and 52 for the purpose of accomodating fasteners 54, 56 and 58, respectively. It should be particularly noted that the coupling means in the form of the recesses 54, 56 and 58 are intermediate the drainage means or channels 42, 44 and 46. The number and location of the coupling means may vary depending on the design of the hydrant body.

FIG. 4 illustrates still another embodiment of the fire hydrant dome 60 comprising the present invention. In this embodiment there are four drainage means in the form of channels 62, 64, 66 and 68 intermediate of which are positioned coupling means defined by recesses 70, 72, 74 and 78 in combination with fasteners 80, 82, 84 and 86, respectively.

Both of the embodiments of FIG. 3 and FIG. 4 provide drainage means in the same form as in the embodiment of FIG. 1. That is, the channels or troughs in each embodiment slope downwardly from a location proximate the valve stem to a location opposite a portion of the valve body whereby fluids and debris can drain directly therefrom without collecting. In addition, each of the three embodiments described hereinbefore provide coupling means in the form of a combination of recesses and fasteners which are positioned intermediate the drainage channels or grooves. In this connection it should be noted that the drainage channels are substantially U-shaped or V-shaped in each of the embodiments and may comprise a pair of flat or arcuate, opposed side walls and a flat or arcuate base wall connecting the side walls. In the case of the V-shaped channel there would of course be no base wall as such.

Turning now to FIG. 5 there will be seen a modification of the embodiment shown in FIG. 1. Whereas the embodiment in FIG. 1 provides a dome 12 having the uppermost portion thereof in substantially the same plane as the top of the valve stem 34, the embodiment shown in FIG. 5 provides a dome 88, the uppermost portion 90 of which is somewhat higher than the topmost surface of the valve stem. As with the previously described embodiments, the embodiment shown in FIG. 5 may have two, three or four drainage channels equally spaced apart with coupling means being positioned intermediate adjacent ones of the drainage channels.

In FIG. 6 there is shown a tool that may be employed for opening the fire hydrant valve. The tool, generally designated by the reference character 92, includes an elongated handle 94, at one end of which is a body portion 96 that is also provided, at end face 98, with a pentagonal socket 100 of the same size and shape as the valve stem.

A tool is shown in FIG. 7 that may be employed for securing the dome 12 to the body 102 of the fire hydrant. A first socket wrench 104 is engaged with the head 106 of a fastener 108. A second socket wrench 110 engages a nut 112 which is threaded onto the fastener 108. The tool 110 may be used to hold the nut 112 stationary while the tool 104 is rotated or, alternatively, the tool 104 may be rotated while the tool 110 is maintained stationary.

As shown fragmentarily in transverse cross-section in FIGS. 8A, 8B and 8C, respectively, the drainage channels comprising this invention may be at least partially arcuate, may have flat side and bottom walls or may be V-shaped.

It will be evident from the foregoing that an improved cover for a fire hydrant has been provided. The improved cover assures that debris or liquid cannot accumulate about the valve stem of the fire hydrant. Adequate and efficient drainage is provided so that there will be no delay in utilizing the fire hydrant in the event of an emergency. Moreover, the upwardly open design of the drainage channels permits very easy clearance thereof should vandals attempt to stuff the channels. The improved cover comprising the present invention may be readily substituted for a conventional cover or may be designated as original equipment. Depending upon the environment, two, three, four or more drainage channels may be provided with the means for coupling the cover to the body of the fire hydrant being positioned preferably, intermediate the drainage channels. Each of the drainage channels is formed in the outer surface of the dome such as by casting, machining or the like and slopes downwardly from a location proximate the valve stem to a location opposite a portion of the valve body to thereby permit fluid and/or debris to drain therefrom without collecting about the exposed stem at the center of the dome that is used for angularly displacing the valve between open and closed positions.

There has been disclosed heretofore the best embodiments of the invention present contemplated. However, various changes and modifications may be made thereto without departing from the spirit of the invention.

What is claimed is:

1. A cover for a fire hydrant that includes a valve body having a valve stem extending upwardly therefrom, said cover comprising:

a cup-shaped dome defined by a wall that is adapted to be positioned over and around the valve body;

means for coupling said dome to the fire hydrant;

an opening in said dome for rotatably receiving a tool that is adapted to mate with and angularly displace the valve stem between open and closed positions; and elongated and downwardly sloping drainage means formed in the outer surface of the wall of said dome, said drainage means having a first upper end positioned at a location proximate the valve stem and a second lower end positioned at a location opposite a portion of the valve body, said drainage means being further defined by side wall means connected to each other such that all surfaces of said drainage means are completely open to the atmosphere and face away from the interior of said dome throughout their entire length whereby fluid and/or debris can drain therefrom without collecting.

2. The cover according to claim 1 wherein said drainage means are defined by at least two diametrically opposed channels.

3. The cover according to claim 2 wherein each of said channels include a pair of opposed side walls and a base wall connecting said side walls.

4. The cover according to claim 3 wherein at least said base wall is arcuate.

5. The cover according to claim 3 wherein said side walls and said base wall are flat.

6. The cover according to claim 2 wherein each of said channels is substantially U-shaped in transverse cross-section.

7. The cover according to claim 2 wherein each of said channels is substantially V-shaped in transverse cross-section.

8. The cover according to claim 2 wherein said coupling means are located intermediate said channels.

9. The cover according to claim 1 wherein said drainage means are defined by three equally spaced apart channels.

10. The cover according to claim 9 wherein each of said channels includes a pair of opposed side walls and a base wall connecting said side walls.

11. The cover according to claim 10 wherein at least said base wall is arcuate.

12. The cover according to claim 10 wherein said side walls and said base walls are flat.

13. The cover according to claim 9 wherein each of said channels is substantially U-shapoed in transverse cross-section.

14. The cover according to claim 9 wherein each of said channels is substantially V-shaped in transverse cross-section.

15. The cover according to claim 9 wherein said coupling means are intermediate said channels.

16. The cover according to claim 1 wherein said drainage means are defined by at least four equally spaced apart channels.

17. The cover according to claim 16 wherein each of said channels includes a pair of opposed side walls and a base wall connecting said side walls.

18. The cover according to claim 17 wherein at least said base wall is arcuate.

19. The cover according to claim 17 wherein said side walls and said base wall are flat.

20. The cover according to claim 16 wherein each of said channels is substantially U-shaped in transverse cross-section.

21. The cover according to claim 16 wherein each of said channels is substantially V-shaped in transverse cross-section.

22. The cover according to claim 16 wherein said coupling means are intermediate said channels.

23. The cover according to claim 2 wherein the top of the wall of each said channel is, in the assembled condition, in substantially the same plane as the top of the valve stem.

24. The cover according to claim 1 wherein the top of said dome is, in the assembled condition, above the top of the valve stem.

* * * * *